US005704334A

United States Patent [19]

Kato

[11] Patent Number: 5,704,334

[45] Date of Patent: Jan. 6, 1998

[54] ENGINE THROTTLE SENSOR

[75] Inventor: Masahiko Kato, Hamamatsu, Japan

[73] Assignee: Sanshin Kogyo Kabushiki Kaisha, Shizuoka, Japan

[21] Appl. No.: 658,932

[22] Filed: May 31, 1996

[30] Foreign Application Priority Data

May 31, 1995 [JP] Japan ..... 7-134430

[51] Int. Cl.[6] ..... F02D 9/10; F02M 61/14

[52] U.S. Cl. ..... 123/336; 123/456; 123/703; 123/195 A; 123/195 HC

[58] Field of Search ..... 123/336, 59.5, 123/456, 195 A, 195 E, 195 P, 195 HC, 703

[56] References Cited

U.S. PATENT DOCUMENTS 4,688,533 8/1987 Otobe ..... 123/336

4,702,202 10/1987 Hensel et al. ..... 123/456

4,864,996 9/1989 Hensel ..... 123/336

4,903,648 2/1990 Lassankse ..... 123/65 R 5,394,846 3/1995 Jaeger et al. ..... 123/336

*Primary Examiner*—Andrew M. Dolinar

*Attorney, Agent, or Firm*—Knobbe, Martens, Olson & Bear, LLP

[57] ABSTRACT

A throttle sensor senses the position of an associated throttle shaft in order to determine the position of a corresponding throttle valve. The position of the throttle sensor is positioned in the engine to reduce the girth of engine. In one embodiment, the throttle sensor lies to the side of a throttle linkage which interconnects a plurality of throttle valves. The throttle sensor and throttle linkage are arranged on a side of an intake manifold opposite a side on which fuel injectors of the engine are located. In another embodiment, the throttle sensor lies at an upper end of the intake manifold and is coupled to a common, vertically oriented throttle shaft that operates a plurality of throttle valves.

20 Claims, 7 Drawing Sheets

ENGINE THROTTLE SENSOR

BACKGROUND OF THE INVENTION

1. Field of the Invention

The present invention relates in general to a marine engine, and more particularly to a position sensor for a throttle device of a marine engine.

2. Description of Related Art

Several outboard motors recently have become equipped with engine control systems in response to increased concerns regarding hydrocarbon emissions. Such systems closely monitor and control the fuel/air ratio of the fuel charge delivered to each cylinder. Engine control systems can significantly reduce hydrocarbon emissions, while improving fuel economy and performance.

An engine control system often includes a throttle sensor which detects the angular position of the throttle valves. The sensor sends a signal indicative of the throttle valve position to an electronic control unit of the engine control system. The electronic control unit uses this information to determine the intake air flow rate into the cylinders and to adjust the amount of fuel delivered to the cylinder to obtain a desired fuel/air ratio.

In several prior engines, the throttle sensor often lies on a side of the carburetors opposite the side on which the throttle linkage operates. This arrangement of the throttle sensor within the engine have previously increased the size of the engine, and thus the size of the power head. The power head of an outboard motor generally extends above the transom of the watercraft and, consequently, a larger power head produces greater aerodynamic drag on the watercraft as the watercraft speeds over the water. The size and shape of the power head thus directly affect the amount of drag produced. The prior arrangement of the throttle sensor within the engine has negatively increased the drag experienced by the outboard motor.

SUMMARY OF THE INVENTION

A need therefore exists for an improved arrangement of a throttle sensor within a marine engine in order to minimize the girth of the engine.

One aspect of the present invention thus involves a marine engine including an induction system. The induction system comprises a plurality of throttle devices which communicate with intake passages of an engine intake manifold. A throttle linkage interconnects the throttle devices so as to synchronize the operation of the throttle devices. Each throttle device includes an operator. The operator controls an opening degree of a throttle valve of the throttle device. At least one fuel injector communicates with each intake passage of the intake manifold. The fuel injectors are positioned on a side of the throttle devices opposite the throttle linkage. A throttle sensor is coupled to one of the throttle operators on the same side of the throttle devices as the throttle linkage.

In accordance with another aspect of the present invention, a marine engine includes an induction system. The induction system comprises a plurality of throttle devices. Each throttle device has a throttle passage, and the throttle devices are positioned in a row such that flow axes through the throttle passages lie generally parallel to one another. A throttle shaft extends through each throttle passage and supports a throttle valve within each throttle passage. The throttle shaft controls an opening degree of the throttle valves within the throttle passages. A throttle sensor is coupled to the throttle shaft to detect the opening degree of the throttle valves.

BRIEF DESCRIPTION OF THE DRAWINGS

These and other features of the invention will now be described with reference to the drawings of preferred embodiments which are intended to illustrate and not to limit the invention, and in which.

DETAILED DESCRIPTION OF PREFERRED EMBODIMENTS

Figure 1:
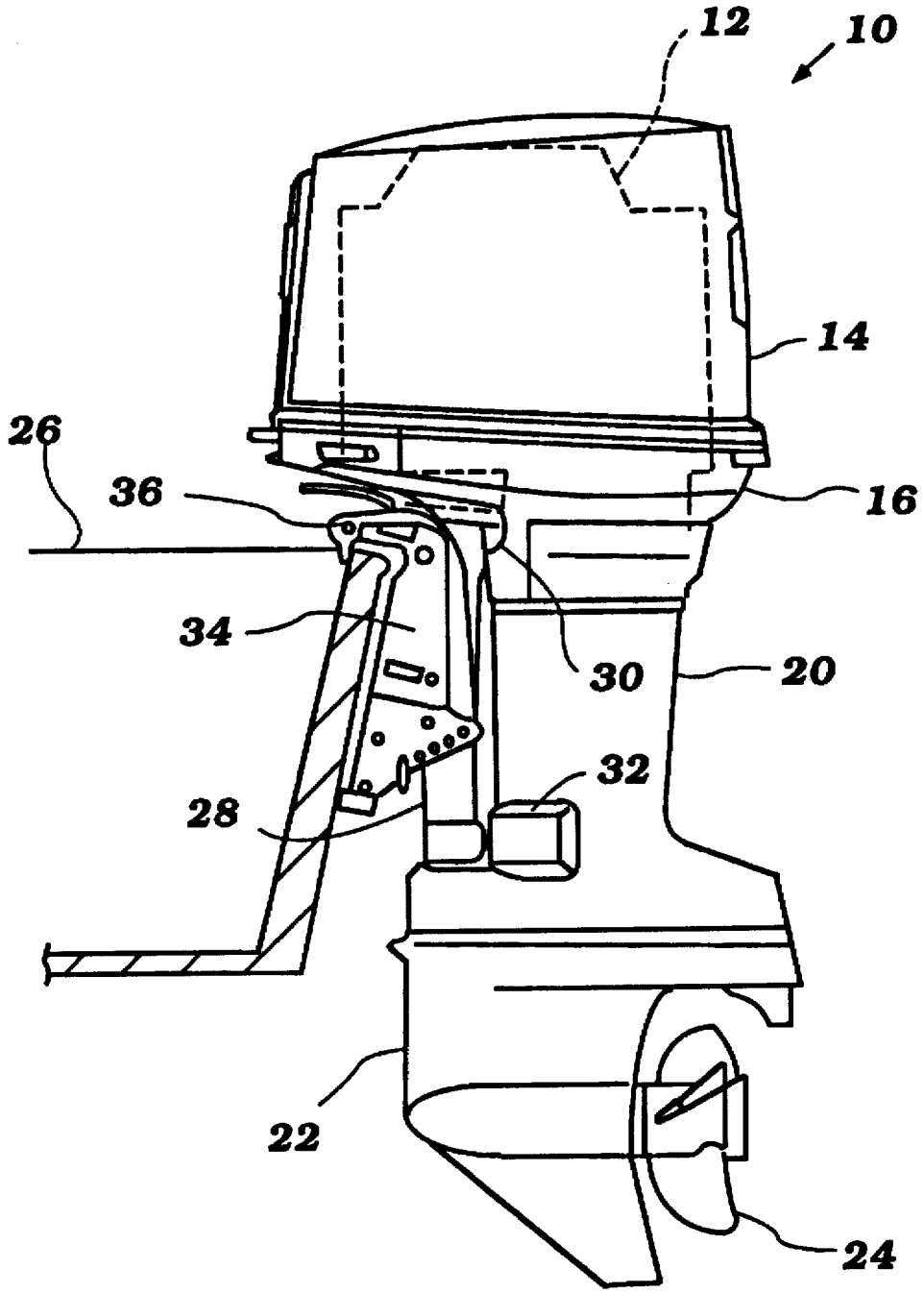
FIG. 1 is a side elevational view of an outboard motor employing an engine which incorporates an engine throttle sensor configured and arranged within the engine in accordance with a preferred embodiment of the present invention.

FIG. 1 illustrates an outboard drive 10 which incorporates a valve synchronization mechanism with an engine throttle sensor configured in accordance with the present invention. Because the present valve synchronization mechanism and engine throttle sensor have particular utility with an outboard motor employing a vertically-oriented engine, the valve synchronization mechanism and engine throttle sensor are described below in connection with an outboard motor; however, the depiction of the invention in conjunction with an outboard motor is merely exemplary. Those skilled in the art will readily appreciate that the present throttle sensor can be used with an inboard motor of an inboard/outboard drive, with an inboard motor of a personal watercraft, and with other types of watercraft engines as well.

The outboard drive 10 includes a power head that comprises an internal combustion engine 12 and a surrounding protective cowling. The cowling includes a main cowling portion 14 that is detachably connected to a tray portion 16.

The engine 12 is mounted conventionally with its crankshaft 18 (FIG. 2) rotating about a generally vertical axis. The crankshaft 18 drives a drive shaft (not shown), as known in the art. The drive shaft depends from the power head of the outboard drive 10.

A drive shaft housing 20 extends downward from the lower tray 16 and terminates in a lower unit 22. As understood from FIG. 2, the drive shaft extends through and is journaled within the drive shaft housing 20. The drive shaft depends into a lower unit 22 where it can selectively be coupled to a propulsion device 24 for driving the propulsion device 24 in selected forward or reverse directions to propel a watercraft 26. In the illustrated embodiment, the propulsion device comprises a propeller; however, other types of propulsion devices, such as, for example, a counter-rotating twin propeller system, a hydrodynamic jet pump or the like can be used as well.

A conventional forward-reverse bevel gear transmission (not shown) is provided for selectively coupling the drive shaft with a propulsion shaft to drive the propulsion device 24. The propulsion shaft drives the propulsion device 24 in a suitable known manner.

A steering shaft assembly 28 is affixed to the drive shaft housing 20 by upper and lower brackets 30, 32. The brackets 30, 32 support the shaft assembly 28 for steering movement. Steering movement occurs about a generally vertical steering axis which extends through the steering shaft assembly 28. A steering arm (not shown) which is connected to an upper end of the steering shaft assembly 28 can extend in a forward direction for manual steering of the outboard drive 10, as known in the art.

The steering shaft assembly 28 also is pivotably connected to a clamping bracket 34 by a pin 36. The clamping bracket 34, in turn, is configured to attached to the transom of the watercraft 26. This conventional coupling permits the outboard drive 10 to be pivoted relative to the pin 36 to permit adjustment of the trim position of the outboard drive 10 and for tilt-up of the outboard drive 10.

Although not illustrated, it is understood that a conventional hydraulic tilt and trim cylinder assembly, as well as a conventional hydraulic steering cylinder assembly can be used as well with the present outboard drive 10. The construction of the steering and trim mechanism is considered to be conventional and, for that reason, further description is not believed necessary for appreciation and understanding of the present invention.

Figure 2:
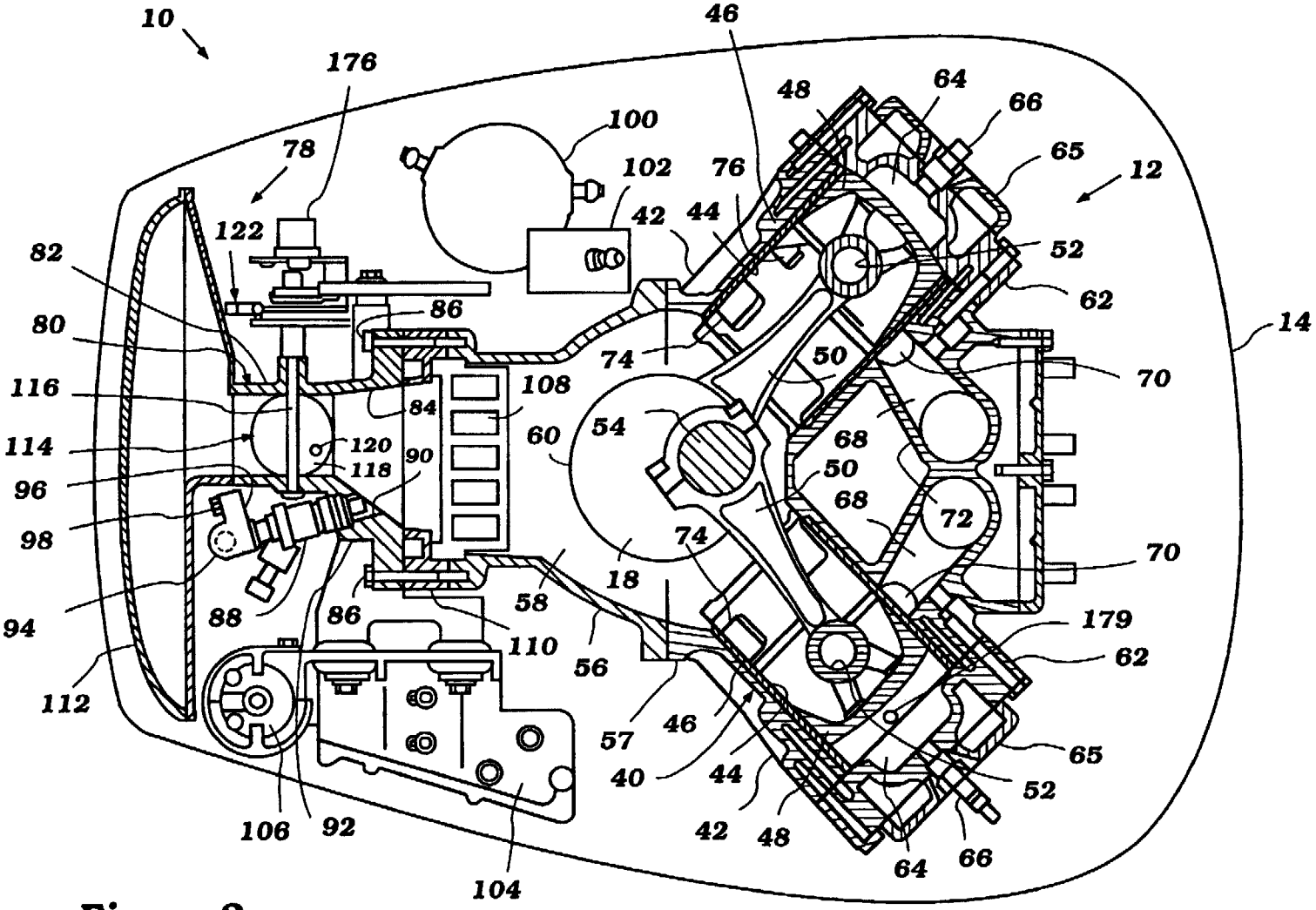
FIG. 2 is a cross-sectional, top plan view of the engine of FIG. 1.

With reference to FIG. 2, the engine 12 is, in the illustrated embodiment, a reciprocating multi-cylinder engine operating on a two-cycle crankcase compression principle. The engine 12 has a V-type configuration, though it will be readily apparent to those skilled in the art how the invention can be utilized equally well with engines having other cylinder arrangements, such as, for example, in-line or slant cylinder arrangements, and operate on other than a two-cycle crankcase compression principle, such as, for example, a four-cycle principle. In addition, although the following described the present engine throttle sensor in combination with a fuel injected engine, it is also understood that the present invention has applicability to carbureted engines.

A cylinder block assembly 40 of the engine 12 lies within the power head. The cylinder block 40 includes a pair of inclined cylinder banks 42 which extend at an angle relative to each other to give the engine a conventional V-type configuration.

Each cylinder bank 42 includes a plurality of parallel cylinder bores 44 that are formed by cylinder liners 46. Each cylinder liner 46 is cast or pressed in place in a cylinder bank 42.

Pistons 48 reciprocate within the bores 44 and are rotatably journaled about the small ends of connecting rods 50 by means of piston pins 52. The big ends of the connecting rods 50 in turn are journaled about throws 54 of the crankshaft 18.

As is typical with V-type engine arrangements, the cylinder bores 44 of the first cylinder bank 42 are offset slightly in the vertical direction from the cylinder bores 44 of the second cylinder bank 42 so that the connecting rods 50 of adjacent cylinder bores 44 can be journaled on the same throw 54 of the crankshaft 18, as shown in FIG. 2.

A crankcase member 56 and a skirt 57 of the cylinder block assembly 40 cooperate to form the crankcase. The crankshaft 18 is journaled for rotation in the crankcase. The crankcase is divided into a plurality of chambers 58, with each chamber communicating with the respective cylinder bore 44. As is typical with two-cycle crankcase compression engines, the crankcase chambers 58 associated with each cylinder bore 44 are sealed relative to each other in a manner which includes utilizing a sealing disc 60 provided on the crankshaft 18.

A pair of cylinder head assemblies 62 are affixed to the cylinder banks 42. Each cylinder head assembly 62 closes the ends of the cylinder bores 44 which are opposite to the ends that open into the crankcase chamber 58.

The cylinder heads 62 define a recess which cooperates with the bores 44 and heads of the pistons 48 to form combustion chambers 64, whose volume varies cyclicly with the motion of the pistons 48. The open upper ends of the cylinder heads 62 are sealed by covers 65 that are affixed to the cylinder heads 62 by any suitable means.

A spark plug 66 is mounted atop each recess of the cylinder head 62 and has its gap extending into the combustion chamber 64. The spark plugs 66 are fired by an ignition control circuit (not shown) that is controlled by an electronic control unit (ECU) of the engine 12.

As seen in FIG. 2, exhaust passages 68 extend away from each cylinder bore 44 of the cylinder bank 42 along the sides which face the opposite cylinder bank 42. The exhaust passages 68 open to the cylinder bores 44 at an exhaust port 70. The exhaust passages 68 of each cylinder bank 42 communicate with a common exhaust manifold 72, which routes exhaust gases through an exhaust system (not shown) for discharge from the outboard drive 10.

One or more scavenge passages (not shown) are formed within each cylinder bank 42. Each passage includes an inlet port 74 which is disposed in the lower end of the bore 44 and opens to the crankcase chamber 58, and an outlet port 76 which is disposed at a longitudinal position along the bores 44 that is slightly below and on the opposite side of the exhaust passage 68 and opens to each of the bores 44.

An induction system 78 of the engine 12 supplies a fuel/air charge to the individual crankcase chambers 58 from the crankcase side of the engine 12. The induction system 78 thus communicates with each crankcase chamber 58 on a side of the engine 12 opposite of the cylinder banks 42.

Figure 3:
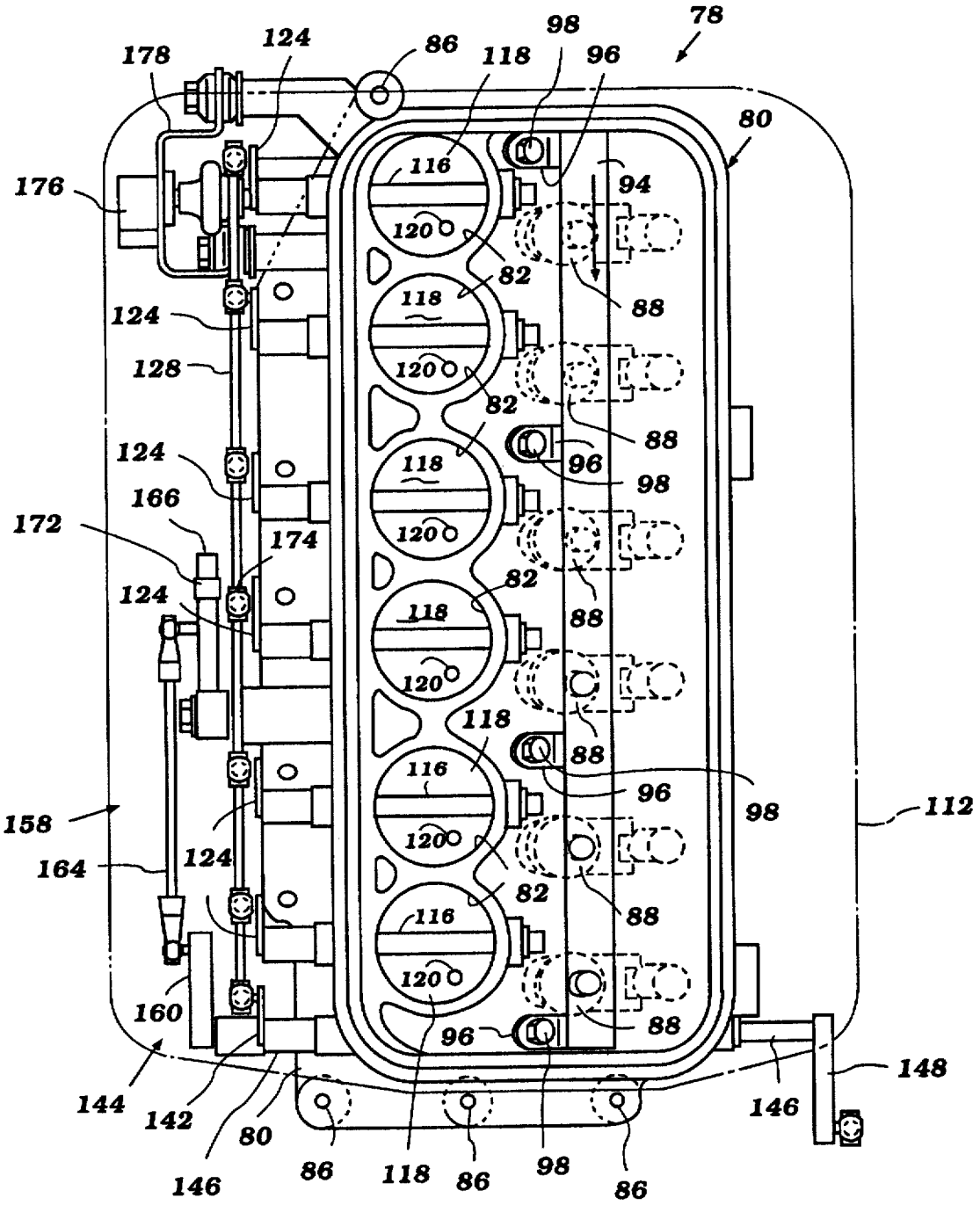
FIG. 3 is a front elevational view of an induction system of the engine of FIG. 2 with a plenum chamber cover shown only in outline.

As understood from FIGS. 2 and 3, the induction system 78 includes an integral intake manifold 80. The manifold 80 defines a plurality of throttle passages 82, each of which open into a dedicated intake passage 84. Each intake passage 84 communicates with a corresponding crankcase chamber 58 of the engine 12. In the illustrated embodiment, the throttle passages 82 are aligned along a generally vertical axis so as to lie above one another.

Bolts 86 attach an outlet end of the intake manifold 80 to an end of the crankcase member 56 opposite the cylinder block assembly 40. In this position, the intake passages 84 are placed in communication with a respective crankcase chamber 58.

At least one fuel injector 88 injects fuel into the air stream passing through each intake passage 84. In the illustrated embodiment, the fuel injector 88 lies to the side of the intake passage 84, with a nozzle of the fuel injector 88 communicating with the intake passage 84 through an aperture 90. The fuel injector 88 is mounted in each intake passage 84 so that it will spray toward the center line of the intake passage 84.

A boss 92 supports the fuel injector 88 in this desired position. The boss 92 includes the aperture 90 which lies to the side of the intake passage 84 and receives a portion of the injector 88 to support the injector 88 in this position. For this purpose, the fuel injector 88 can include an external threaded section which is screwed into the aperture 90 of the boss 92.

Each fuel injector 88 includes a solenoid winding which is energized in a conventional manner. When energized, the fuel injector 88 injects fuel into the air stream passing through the intake passage 84 in the intake manifold 80. The ECU controls the fuel injector timing and thus the operation of the fuel injectors 88.

A fuel rod 94 delivers fuel to each fuel injector 88. The fuel rod 94 desirably extends along the end surface of the intake manifold 80 and is removably secured to the intake manifold 80. For this purpose, as best seen in FIGS. 2 and 3, the fuel rod 94 includes a plurality of flanges 96 which extend to the side of the fuel rod 96. Bolts 98 attach the flanges 96 to the intake manifold 80 at the upper and lower ends of the intake manifold 80, as well as at several positions therebetween. In this manner, the fuel rod 94 is securely mounted to the intake manifold 80, while being easily removed for service. The limited contact between the fuel rod 94 at its mounting flanges 96 and the intake manifold 80 also limits heat conduction to the fuel rod 94.

A fuel delivery system delivers highly pressurized fuel to the fuel rod 94. The fuel system includes a fuel tank (not shown) which is provided externally of the outboard drive, normally within the hull of the watercraft 26. With reference to FIG. 2, a low-pressure pump 100 draws fuel from the fuel tank through a conduit (not shown) and a fuel filter 102. The fuel filter 102 and low-pressure pump 100 are located within the cowling 14 on a side of the intake manifold 80 opposite of the fuel rod 94. The low-pressure pump 100 supplies fuel to a vapor separator 104 located on the other side of the intake manifold 80 (i.e., the side on which the fuel rod is located). The vapor separator 104 separates fuel vapor from the fuel and delivers the vapor to the induction system 78, in a known manner.

A high-pressure fuel pump 106 draws fuel from the vapor separator 104 and delivers fuel to the fuel rod 94 which supplies the individual fuel injectors 88, as described above. A return line connects to the vapor separator 104 to complete a high-pressure fuel circuit through which fuel is circulated. A pressure regulator desirably is disposed within the high-pressure fuel circuit so as to maintain a uniform fuel pressure at the injectors 88 (e.g., 50 to 100 atm). The regulator regulates pressure by dumping excess fuel back to the vapor separator 104, as known in the art. The above description of the construction of the fuel delivery system is generally conventionary and, thus, further details of the fuel delivery system are not necessary for an understanding of the present invention.

As seen in FIG. 2, each intake passage 84 delivers the fuel-air charge to the respective crankcase chamber 58 through a reed-type valve 108 connected to the intake manifold 80. The reed-type valve 108 permits air to flow into the crankcase chamber 58 when the corresponding piston 48 moves towards top dead center (TDC), but precludes reverse flow when the piston 48 moves towards bottom dead center (BDC) to compress the charge delivered to the crankcase chamber 58. The reed-type valves 108 are mounted to a support plate 110 that lies between the intake manifold 80 and the crankcase member.

An intake silencer or plenum chamber 112 of the induction system 78 communicates with an inlet end of the intake manifold 80. The engine 12 draws air into the plenum chamber 112 from the interior of the cowling 14 through at least one air inlet and significantly silences the intake air flow before passing through the throttle passages 84 of the intake manifold 80.

A throttle device 114 operates within each throttle passage 82 of the intake manifold 80. The plurality of throttle devices 114 control air flow into the engine 12, as known in the art.

The throttle device 114 can include any of a wide variety of type of throttling device, such as, for example, a sliding valve and butterfly valve, or the like. For the purpose of illustration, the linkage system will be described in connection with the operation of a plurality of throttle shafts 116 which support the butterfly-type valves 118 within the throttle passages 82. Inlet air passes through the throttle passage 82 when the throttle shaft 116 is rotated to open the valve 118.

Figure 4:
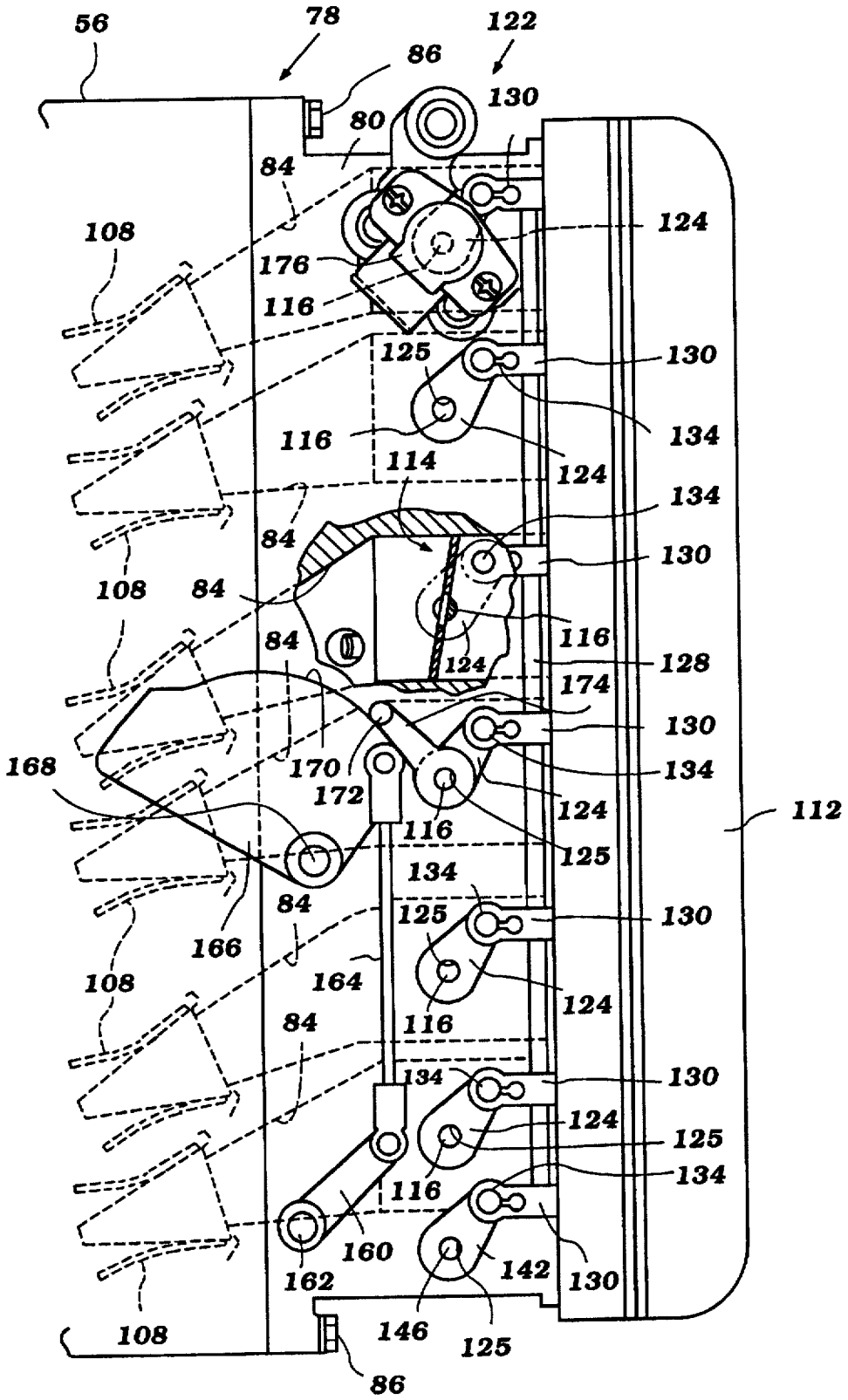
FIG. 4 is an enlarged, side elevational, partial sectional view of the induction system of FIG. 3.

Each valve 118 has a generally circular, disc-like shape with a diameter slightly larger than the diameter of the throttle passage 82. Thus, as seen in FIG. 4, the valve 118 does not quite lie perpendicular to the flow through the throttle body 82 when closed. The valve 118 also includes a small hole 120 positioned on the lower side of the valve 118 through which air flows when the valve 118 is closed. The hole 120 desirably lies near the aperture 90 through which the fuel injector 88 injects fuel into the intake passage 84.

In the illustrated embodiment, each throttle device 114 controls air flow into a specific crankcase chamber 58. That is, the induction system 78 includes a plurality of throttle valves 118 that correspond in number to the number of crankcase chambers 58. Each throttle valve 118 is dedicated to control the air flow into a respective crankcase chamber 58.

A throttle operator 122 operates the throttle valve 118. In the illustrated embodiment, the throttle operators 122 each include the corresponding throttle shaft 116 that supports the valve 118 within the passage 82 and a throttle lever 124. The throttle levers 124 desirably have an identical shape and size.

Each throttle lever 124 is attached to the corresponding throttle shaft 116 of the throttle device 114. An end of the throttle lever 124 is affixed onto the throttle shaft 116 by inserting the throttle shaft 116 into an aperture 125 at the end of the throttle lever 124. In the illustrated embodiment, as seen in FIG. 4, the throttle lever 124 is positioned to extend upwardly and slightly toward the inlet end of the intake manifold 80 with the valve 118 in a closed position.

The throttle levers 124 rotate from the position illustrated in FIG. 4 (i.e., a closed position) to a wide-open position in which the valve 118 lies generally parallel to the air flow through the throttle passage 84. The throttle levers 124 and associated shafts 116 rotate through a little less than 90° (e.g., 80°) to move the corresponding valves 118 between the fully closed position illustrated in FIG. 4 and the wide-open position.

The throttle synchronization mechanism operates the throttle valves 118 in unison. The throttle synchronization mechanism includes a throttle linkage 126 connected to the throttle operators 122 so as to uniformly and simultaneously operate and control the throttle valves 118. In the illustrated embodiment, the throttle linkage 126 is coupled to each of the throttle levers 124 and lies generally parallel to the fuel rod 94. Both the fuel rod 94 and the throttle linkage 126 also extend in directions which are generally parallel to the row of throttle passages 82. In order to simplify the construction of the induction system 78, the throttle linkage 126 desirably lies on a side of the intake manifold 80 opposite of the fuel rod 94.

With reference to FIG. 4, the throttle linkage 126 comprises an elongated link 128. In the illustrated embodiment, the link 128 is a straight metal linkage rod. The linkage rod 128 has a length slightly smaller than the height of the intake manifold 80 (as seen in FIG. 4). The link 128, however, can take others forms. For instance, the link 128 can have an out-of-round cross-sectional shape (e.g., square), as well as various jogs along its length. The link 128 also can be formed of a plurality of interconnected pieces; however, a single metal rod is preferred.

A plurality of lugs 130 extend from the link 128. In the illustrated embodiment, each lug 130 includes a mounting aperture 132 through which a portion of the link 128 passes. The lugs 130 are positioned at various points along the link 128 which correspond with the position of the associated throttle lever 124. The lugs 130 can be resin-bonded to the link 128, or can be releasably fixed in place along the link 128 by conventional set-screws or like means. With the latter form of attachment, the throttle valves 118 can be synchronized by adjusting the position of the corresponding lugs 130 along the length of the link 128.

Each lug 130 extends to the side of the link 128. A connector 134 is formed at an outer end of the lug 130. The connector 134 is configured to attach to the lever 124 in a manner allowing rotation between the lever 124 and the lug 130. The point of attachment between the lug 130 and lever 124 desirably is offset from the longitudinal axis of the link by a distance e.

Figure 5:
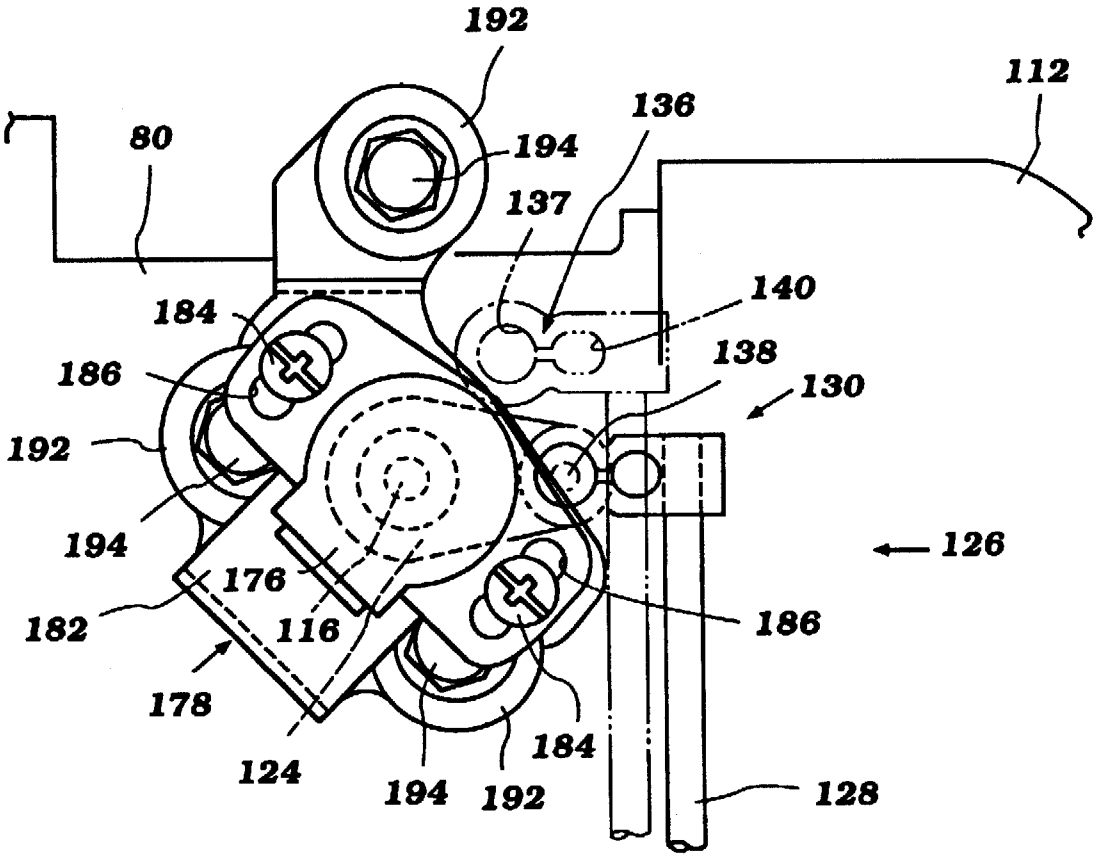
FIG. 5 is an enlarged side elevational view of the throttle sensor configured and arranged in the engine in accordance with a preferred embodiment of the present invention.
Figure 6:
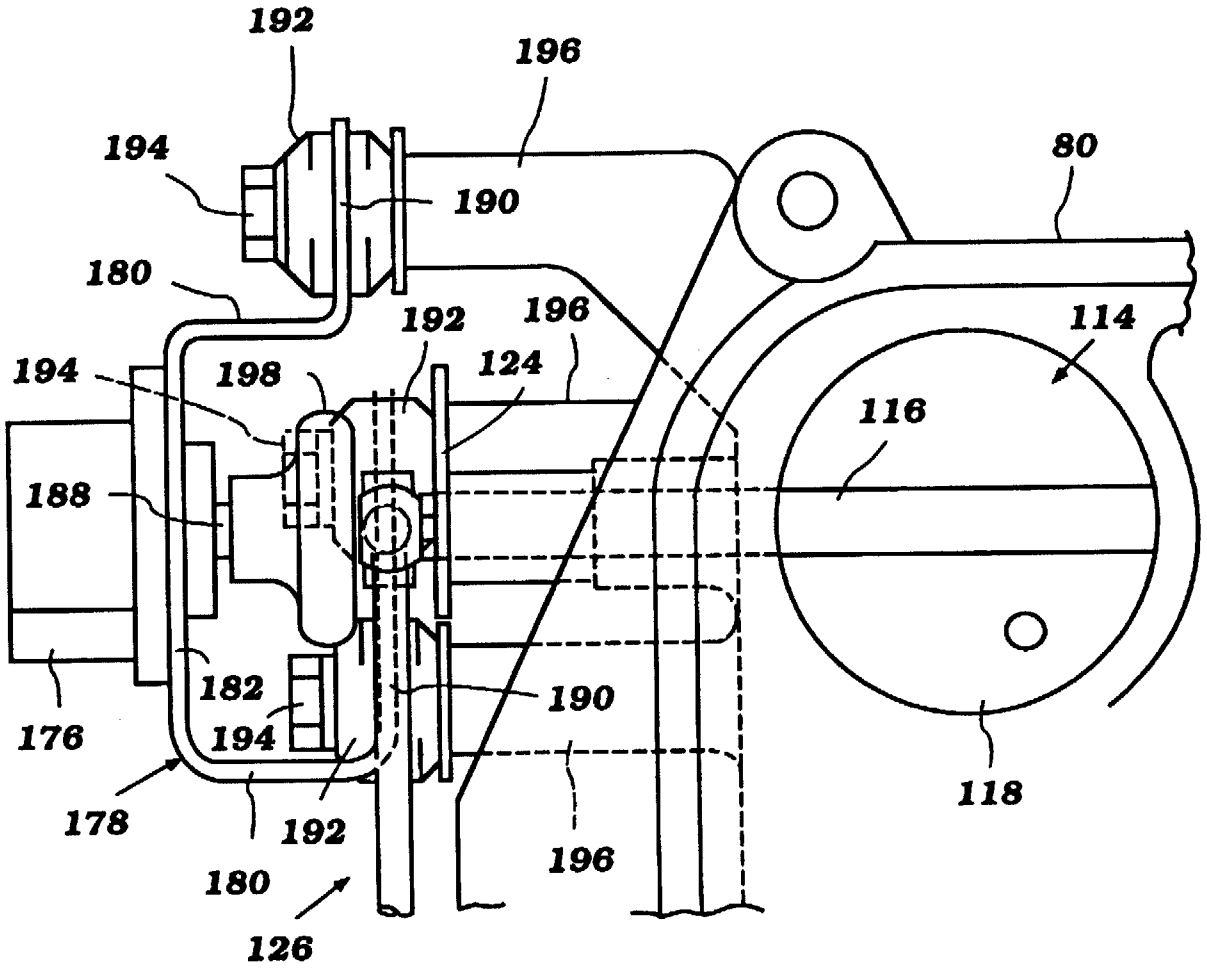
FIG. 6 is a top plan view of the throttle sensor of FIG. 5.

In the illustrated embodiment, as best seen in FIGS. 5 and 6, the connector 134 comprises an aperture 136 which engages a snap 138 positioned on the end of the corresponding throttle lever 124. The aperture 136 is an engagement hole 137 which has a generally spherical shape that corresponds in size to a spherically-shaped head of the snap 138. The aperture 136 also includes relief 140 positioned to the side of the engagement hole 137. The relief 140 allows the walls of the lug 130 about the engagement hole 137 to flex outwardly when the head of the snap 138 is inserted into the engagement hole 137. The lug 130 desirably is formed of an elastic plastic which returns to an undeflected state once the head of snap 138 lies within the engagement hole 137. In this manner, the connector 134 of the lug 130 receives the snap head in a snap-fit manner to inhibit disengagement between the lug 130 and the lever 124, while allowing the lug 130 and lever 124 to rotate relative to each other.

As seen in FIG. 4, each lug 130 connects to the corresponding lever 124 of the throttle operator 122. The position of the lugs 130 along the length of the link 128 correspond to the position of an engagement end of the lever 124 on which the snap 138 is formed with the throttle valve 118 lying at the same angular position. The uppermost lug 130 lies at an upper end of the link 128 and connects to the uppermost lever 124. The next to the lowermost lug 130 connects to the lever 124 of the lowermost throttle operator 122.

With reference to FIGS. 3 and 4, the lowermost lug 130 connects to a lever 142 of an oil pump actuation mechanism 144. The lever 142 is fixed to an actuator shaft 146 which extends through and is journaled within the integral body of intake manifold 80. In the illustrated embodiment, the actuator shaft 146 generally lies parallel to the throttle shafts 116 and extends entirely through the intake manifold 80. The actuator shaft 146 connects to another lever 148 on an opposite side of the manifold 80. The lever 148 in turn operates an oil pump (not shown) which injects oil into the fuel vapor separator 104 of the high-pressure fuel circuit described above.

In addition to actuating the oil pump, the actuator shaft 146 improves the rigidness of the throttle linkage 126. The actuator shaft 146, which is not connected to a throttle valve 118, resists twisting caused by the resultant forces produced by air flow over the throttle valves 118. This counter-acting effect further stabilizes the throttle linkage 126.

With reference to FIGS. 3 and 4, an actuator mechanism 158 of the throttle valve synchronization system actuates the throttle linkage 126. The actuator mechanism 158 includes an actuator lever 160 which rotates about a shaft 162 fixed to the exterior of the intake manifold 80. The actuator lever 180 can be operated by a conventional throttle controller including bowden-wire cables.

A linkage rod 164 connects the actuator lever 160 to a rotatable cam 166. The cam 166 rotates about a support shaft 168 fixed to the exterior of the intake manifold 80. The cam 166 includes an arcuate cam surface 170 positioned on an outer edge of the cam 166.

A follower 172 cooperates with the cam surface 170 to move over the cam surface 170 as the cam 166 is rotated by the actuator lever 160. The follower 172 is connected to a second actuator lever 174 which is coupled to one of the throttle levers 174. The second actuator lever 174 desirably is coupled to the throttle lever 124 in a manner which causes the actuator lever 174 and the throttle lever 124 to move together. In the illustrated embodiment, these two levers are jointed together such that the throttle lever 124 rotates with the actuator lever 174. The actuator lever 174 thus also rotates the corresponding throttle shaft 116 and valve 118. The actuator lever 174 desirably is coupled to the third throttle device 114 up from the bottom of the intake manifold 80.

Although not illustrated, a biasing mechanism desirably biases the throttle valves 118 to the closed position. The biasing mechanism desirably is one or more torsion springs disposed between the throttle levers 124 and the intake manifold 80 and/or between the oil pump actuator lever 148 and the intake manifold 80. The biasing mechanism acts against the movement imparted to the linkage system 126 by the actuator mechanism 158.

A throttle valve angle sensor 176 cooperates with the throttle linkage 126 to sense the opening degree of the throttle valves 118. The throttle angle detector 176 communicates with the electronic control unit (ECU) (not shown) to control the desired air/fuel ratio.

With reference to FIGS. 3 and 4, the throttle sensor 176 is attached to one of the throttle shafts 116 on the same side of the intake manifold 80 on which the throttle linkage 126 lies, in order to reduce the size of the engine 12. The throttle sensor 176 does not interfere with the position or arrangement of the fuel injectors 88 or fuel rod 94 in this position. As seen in FIG. 3, the throttle sensor 176 also lies within a space existing directly behind the plenum chamber cover 112 and above the actuator mechanism 158. In this position, the sensor 176 does not increase the size of the engine 12.

As best seen in FIGS. 5 and 6, a bracket 178 supports the throttle sensor 176 to the side of the throttle linkage 126 and at an outer end of the throttle shaft 116. In the illustrated embodiment, the throttle sensor 176 is coupled to the throttle shaft 116 of the uppermost throttle device 114 which lies nearest an influent port of the fuel rail 94 (FIG. 2) at the upper end of the rail 94. Thus, the uppermost cylinder determines the amount of fuel injected. Because the injector 88 of the uppermost cylinder is portion near the influent port of the fuel rail 94, fuel pressure at the injector 88 is generally unaffected by the pulsation of fuel pressure produced by the fuel injectors 88 positioned downstream. Sensing the uppermost cylinder thus provides highly accurate fuel injection control.

In order to further improve engine control, the uppermost cylinder can also include an oxygen sensor 179 (FIG. 2). The oxygen sensor 179 desirably is located within the combustion chamber 64 of the cylinder, and more preferably mounted through the wall of the cylinder. The oxygen sensor 179 similarly communicates with the electronic control unit.

In the illustrated embodiment, the bracket 178 includes three legs 180 which support a platform 182. As seen in FIG. 5, screws 184 connect the sensor 176 to the platform 182. The body of the throttle sensor 176 includes a pair of slots 186 which receive the screws 184. In this manner, the position of the throttle sensor 176 on the bracket 178 can be adjusted to precisely align a shaft 188 (FIG. 6) of the throttle sensor 176 with the corresponding throttle shaft 116.

Each leg 180 includes a footing 190 having a mounting aperture. A grommet 192 extends through the mounting aperture to elastically support the bracket 178. And as best seen in FIG. 6, a bolt 194 extends through each grommet 192 and mounting hole to secures the associated footing 190 to a boss 196 formed on the intake manifold 80. This elastic coupling reduces the amount of engine vibration, as well as heat, transfer from the intake manifold 80 to the throttle sensor 176.

The legs 180 of the bracket 178 are arranged so as not to interfere with the operation of the throttle linkage 126. For this purpose, as best seen in FIG. 6, the legs 180 support the platform 182 away from the throttle lever 124.

The shaft 188 of the throttle sensor 176 is connected to the throttle shaft 116 in a suitable known manners. A dust boot 198 desirably encloses the coupling to protect the juncture.

In operation, the first actuator lever 160 is rotated to operate the throttle linkage 126 and to open the throttle valves 118. The linkage rod 164 imparts the rotational movement of the first actuator lever 160 to the cam 166. The follower 172 of the second actuator lever 174 slides over the cam surface 170 with rotation of the cam 166, and the second actuator lever 174 consequently rotates (in the clockwise direction for the embodiment illustrated in FIG. 4). Rotation of the second actuator lever 174 opens the attached throttle valve 118.

The associated throttle lever 124 transmits this rotational movement to the throttle linkage 126. The throttle linkage 126 moves downward, in the illustrated embodiment, as a result. This downward movement of the link 128 causes the balance of the throttle levers 124 as well as the oil pump actuator lever 148 to rotate clockwise. The lugs 130 of the linkage system 126 transmit the downward movement of the link 128 to the outer end of the levers 124. The rotational coupling between the lugs 130 and the levers 124 allows the angle between the lever 124 and the associated lug 130 to change with this movement.

The unitary movement of the lugs 130, which are rigidly connected to each other by the link 128, causes the throttle levers 124 to move in unison. The throttle valves 118 consequently simultaneously open with the opening degree between each valve 118 being substantially the same.

The throttle sensor 176 detects the position of the uppermost throttle shaft 116 throughout its range of movement. Because of the synchronization between the throttle shafts 116 produced by the throttle linkage 126, the position of the uppermost throttle shaft 116 detected by the throttle sensor 176 is indicative of the position of the other throttle shafts 176. The throttle sensor 176 produces a signal indicative of the position which the ECU receives and processes to determine the intake air flow into the engine at a given time. The ECU uses this information to adjust the amount of fuel injected into the intake passages 84 by the injectors 88 in order to produce a fuel/air charge of a desired fuel/air ratio.

The biasing mechanism desirably bias the valves 118 closed. The interaction between the follower 172 and the cam 166, however, establishes the desired position of the throttle valves 118 as described above.

Figure 7:
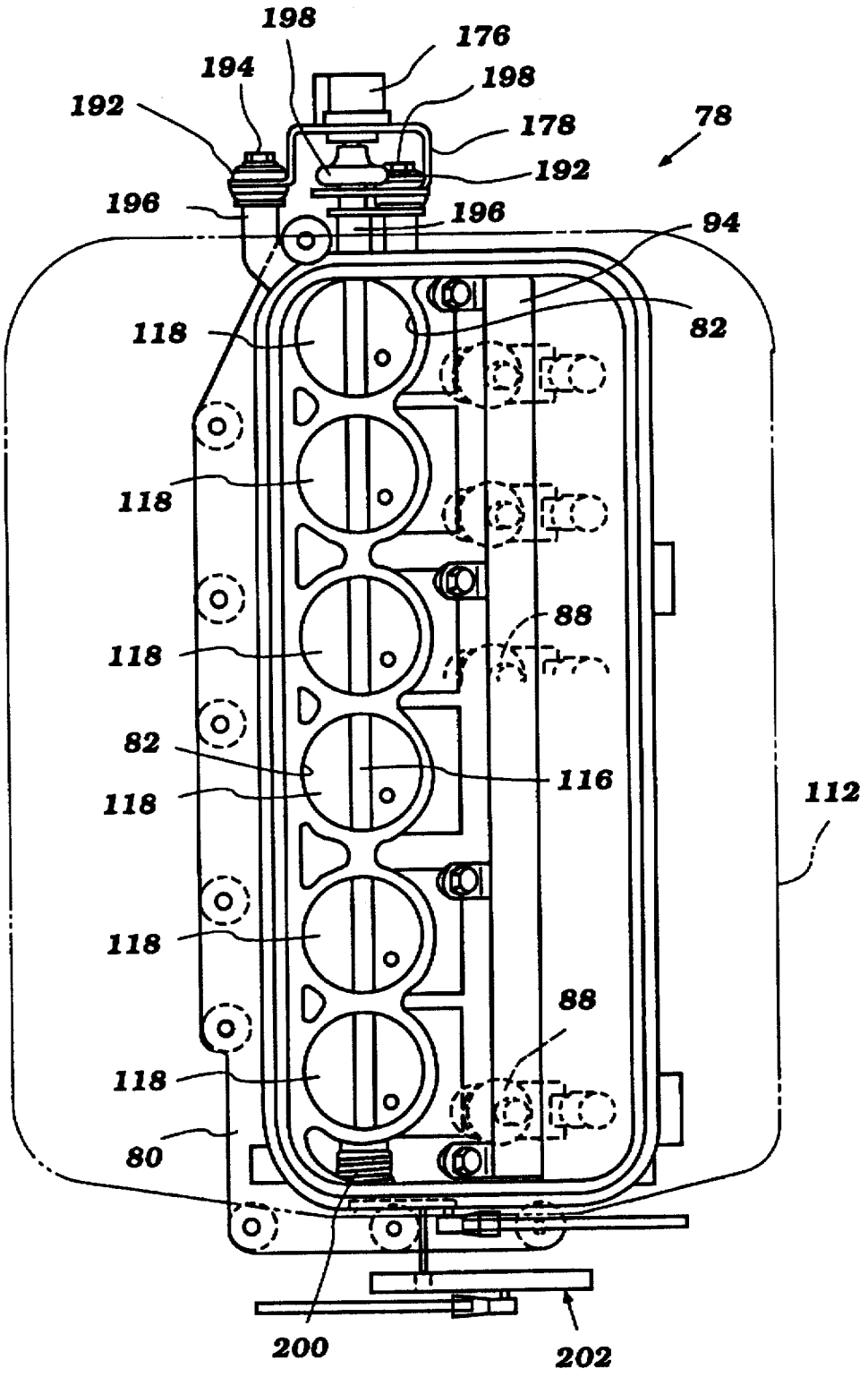
FIG. 7 is a front elevational view of an induction system with a throttle sensor configured in accordance another preferred embodiment of the invention, for use with the engine illustrated in FIG. 2.

FIG. 7 illustrates another embodiment of the assembly between the throttle synchronization mechanism and the throttle sensor. In this embodiment, a single throttle shaft 116 operates each of the throttle valves 118. The throttle shaft 116 extends through each of the throttle passages 82 which are aligned in a row in the vertical direction. Rotation of the throttle shaft 116 opens each throttle valve 118 by the same degree.

The construction of the intake manifold 80 and the associated fuel injectors 88 is substantially identical to that described above, except for the journals which support the vertically disposed throttle shaft 116. The above description of the throttle passages 82, intake passages 84, fuel injectors 88, fuel delivery system and the integral construction of the intake manifold 80 therefore applies equally to those components of the embodiment of FIG. 7, unless noted otherwise. Like reference numerals thus have been used to indicate similar elements between the two embodiments.

A torsion spring 200 operates between the intake manifold 80 and the throttle shaft 116 to bias the throttle valves 118 toward a closed position. A throttle actuator 202 mechanism operates against to torsion spring 118 to move the throttle valves 118 to an open position. In the illustrated embodiment, the torsion spring 200 and the throttle actuator mechanism 202 cooperate with a lower end of the throttle shaft 116.

The throttle sensor 176 is attached to the throttle shaft 116 to determine the position of the throttle valves 118 in the manner described above. In the illustrated embodiment, the throttle sensor 176 is attached to an upper end of the throttle shaft 116. A bracket 178 supports the throttle sensor 176 above the upper end of throttle shaft 116. As seen in FIG. 7, elastic couplers secure the bracket 178 to bosses 196 formed on the upper end of the intake manifold 80. In the illustrated embodiment, the elastic couplers each involve a grommet 192 inserted through a mounting hole of the bracket 178 which a bolt 194 secures to the corresponding boss 196 of the intake manifold 80.

As common to both of the illustrated embodiment, the throttle sensor 176 lies in a position that does not increase the size of the engine 12. For instance, in the embodiment of FIGS. 1 through 6, the position of the throttle sensor 176 allows the throttle linkage 126 to lie adjacent to the ends of the throttle shafts 116 and permits the fuel rod 94 to extend along the side of the intake manifold 80 to communicate with the ends of the fuel injectors 88. In the embodiment of FIG. 7, the throttle sensor 176 lies atop the intake manifold 80 in a previously unoccupied space. As a result of the described component layouts, the size of the engine 12 can be decreased over prior engine designs.

Although this invention has been described in terms of certain preferred embodiments, other embodiments apparent to those of ordinary skill in the art are also within the scope of this invention. Accordingly, the scope of the invention is intended to be defined only by the claims that follow.

What is claimed is:

1. A marine engine including an induction system comprising a plurality of throttle devices which communicate with intake passages of an engine intake manifold, a throttle linkage that interconnects said throttle devices to synchroize the operation of said throttle devices, each throttle device comprising an operator that controls an opening degree of a throttle valve of said throttle device, at least one fuel injector communicating with each intake passage of the intake manifold, said fuel injectors positioned on a side of all of the intake passages opposite of said throttle linkage, and a throttle sensor coupled to one of said throttle operators on the same side of the intake passages as the throttle linkage.

2. A marine engine as in claim 1 additionally comprising a fuel rail that communicates with said fuel injectors, and said fuel rail lies on a side of the intake passages which is opposite the side on which the throttle linkage lies.

3. A marine engine as in claim 2, wherein said fuel rail includes at least an influent port and said throttle sensor is coupled to the throttle operator which lies closest to the fuel injector that is nearest to the influent port of the fuel rail.

4. A marine engine as in claim 3 additionally comprising a variable volume combustion chamber which receives a fuel charge from the intake passage into which the fuel injector nearest the fuel rail influent port injects, and an oxygen sensor communicating with said variable volume combustion chamber.

5. A marine engine as in claim 4, wherein said throttle devices are vertically aligned above one another, and said uppermost throttle device communicates with the intake passage into which the fuel injector, which is nearest to the fuel rail influent port, injects.

6. A marine engine as in claim 1 additionally comprising a bracket which supports said throttle sensor, said bracket being attached to said intake manifold.

7. A marine engine as in claim 6, wherein said throttle sensor is attached to said bracket in a manner permitting the position of the throttle sensor on the bracket to be adjusted.

8. A marine engine as in claim 5 additionally comprising at least one elastic coupler which secures said bracket to said intake manifold.

9. A marine engine as in claim 1, wherein each of said throttle operators comprises a throttle shaft which supports the corresponding throttle valve and a throttle lever attached to said throttle shaft, and said throttle sensor is attached to an end of the throttle shaft with the throttle lever operating between said throttle sensor and a body of the corresponding throttle device.

10. A marine engine as in claim 1 additionally comprising a plurality of variable volume combustion chambers, said plurality of combustion chambers being equal in number to the number of said plurality of throttle devices.

11. A marine engine as in claim 1, wherein the intake passages are arranged above one another within the intake manifold such that one of the intake passages constitutes an uppermost intake passage, and the sensor is coupled to the throttle operator of the throttle device that communicates with the uppermost intake passage.

12. A marine engine as in claim 1 additionally including a plurality of cylinders, the axis of each cylinder lying generally normal to a vertical axis and being arranged such that one of the cylinders constitutes an uppermost cylinder, and an oxygen sensor communicating with the uppermost cylinder.

13. A marine engine including an induction system comprising a plurality of throttle devices and an equal number of intake passages, each throttle device communicating with only one of the intake passages, a throttle linkage which interconnects said throttle devices so as to synchronize the operation of said throttle devices, each throttle device comprising an operator that controls an opening degree of a throttle valve of said throttle device, at least one fuel injector injecting fuel into each intake passage, said fuel injectors positioned on a side of the throttle devices opposite of said throttle linkage, and a throttle sensor coupled to one of said throttle operators on the same side of the throttle devices as the throttle linkage.

14. A marine engine as in claim 13 additionally comprising a fuel rail that communicates with the fuel injectors and that lies on a side of the throttle devices which is opposite of the throttle linkage.

15. A marine engine as in claim 14, wherein the fuel rail includes an influent port, and the sensor is coupled to the throttle operator that lies closest to the fuel injector nearest to the influent port of the fuel rail.

16. A marine engine as in claim 15 additionally comprising a variable volume chamber which receives a fuel charge from the intake passage into which the fuel injector nearest the fuel rail influent port injects, and an oxygen sensor communicating with said variable volume chamber.

17. A marine engine as in claim 13, wherein the throttle devices are arranged above one another such that one of the throttle devices constitutes an uppermost throttle device, and the sensor is coupled to the throttle operator of the uppermost throttle device.

18. A marine engine as in claim 13 additionally comprising a plurality of cylinders, the axis of each cylinder lying generally normal to a vertical axis and being arranged such that one of the cylinders constitutes an uppermost cylinder, and an oxygen sensor communicating with the uppermost cylinder.

19. A marine engine as in claim 13 additionally comprising a bracket which supports the throttle sensor and an adjustment mechanism coupling the sensor to the bracket, whereby the position of the sensor on the bracket can be adjusted to align the sensor with the corresponding throttle operator.

20. A marine engine as in claim 13 additionally comprising a plurality of variable volume chambers, and the plurality of variable volume chambers and the plurality of throttle devices being one in number.

* * * * *